United States Patent [19]

Badiali et al.

[11] Patent Number: 4,637,205

[45] Date of Patent: Jan. 20, 1987

[54] SPLICER DEVICE FOR THE MECHANICAL SPLICING OF TEXTILE YARNS

[75] Inventors: Roberto Badiali, Pordenone; Luciano Bertoli, Salo' ; Claudio Speranzin, Pordenone, all of Italy

[73] Assignee: Officine Savio SpA, Pordenone, Italy

[21] Appl. No.: 651,333

[22] Filed: Sep. 17, 1984

[30] Foreign Application Priority Data

Oct. 4, 1983 [IT] Italy ..... 83469 A/83

[51] Int. Cl.[4] ..... B65H 69/06; D01H 15/00

[52] U.S. Cl. ..... 57/22; 57/261

[58] Field of Search ..... 57/22, 23, 261, 202

[56] References Cited

U.S. PATENT DOCUMENTS

| | | | |
|---|---|---|---|
| 2,028,144 | 4/1931 | Cavanagh | 57/22 |
| 2,362,801 | 11/1944 | Charnock | 57/22 |
| 3,307,339 | 3/1967 | Porter | 57/22 |
| 3,633,352 | 1/1972 | Marriner | 57/22 |
| 4,244,169 | 1/1981 | Ligones et al. | 57/22 |
| 4,341,065 | 7/1982 | Baumgartner et al. | 57/22 |
| 4,341,066 | 7/1982 | Baumgartner | 57/202 X |
| 4,386,494 | 6/1983 | Felix | 57/22 |
| 4,407,117 | 10/1983 | Garnsworthy | 57/22 |

FOREIGN PATENT DOCUMENTS 0039609 11/1981 European Pat. Off. .

*Primary Examiner*—John Petrakes

*Attorney, Agent, or Firm*—Wegner & Bretschneider

[57] ABSTRACT

A splicer device for making a splice between two yarns by the mechanical removal and recomposition of twists having rings to untwist and retwist yarn, grippers to pluck and/or tear excessive yarn tail ends and form small retaining yarn tails, and any of an adjustable cam to separately condition untwisting and retwisting, a spacer to keep the surfaces working on the yarn at least for a moment a distance apart, movable portions on the grippers that move in opposite directions, and a tensioner to permit drawing action.

70 Claims, 22 Drawing Figures

SPLICER DEVICE FOR THE MECHANICAL SPLICING OF TEXTILE YARNS

This invention concerns splicer devices of a type able to obtain a splice of two yarns by the removal and reapplication of twists in such yarns, the whole process being carried out mechanically.

The invention therefore concerns improvements to splicer devices for the mechanical splicing of textile yarns. The invention also concerns a mechanical splicer device that employs such improvements.

Splicer devices working by means of air are known and use a turbulence chamber in which the fibers of the yarns are disassembled and intermingled, so that the yarns are then spliced.

Mechanical splicer devices too are known that make fisherman's knots or knots of another type between the yarns to be spliced.

In particular, mechanical splicer devices are known that work by disassembly and recomposing of yarns by rolling the latter between two elements that can rotate, roll or slide against each other in opposite directions.

In this type of splicer device the disassembly and recomposing of the yarns take place advantageously between zones of the yarns clearly defined by such pairs of elements.

For example, European Patent No. EP-A-39609 (CSIRO), U.S. Pat. No. 4,407,117, is known which discloses a device in which the untwisting and retwisting of yarns positioned parallel to or crossed over each other are performed by a pair of counterrotating disks, the end parts of the segments of yarn forming the splice being controlled by the device constantly.

Devices are known that are the subject of earlier patent applications in the name of the assignee of the present invention and that employ untwisting and retwisting means having a substantially circular shape, such as rings or disks, and which develop the innovative concept of the device of U.S. Pat. No. 4,407,117.

In particular, U.S. application Ser. No. 438,805 filed Nov. 3, 1982, now U.S. Pat. No. 4,577,459, discloses a procedure for the mechanical splicing of textile yarns by untwisting, coupling together, and thereafter retwisting the yarns thus coupled, excessive tail ends of the yarns being eliminated.

This patent application discloses also a mechanical splicer device that performs such procedure. This splicer device comprises two facing opposed ring means, of which at least one can be displaced in relation to the other and between which the yarns to be spliced are positioned.

Such splicer device comprises also:

means to bring the yarns close to each other, intermediate clamp means that cooperate with means that pluck and/or tear excessive tail ends of the yarns, retwisting means which consist preferably of disks within such ring means, and means to actuate the various functions.

With a view to obtaining remaining tails of yarn having a substantially tapered and narrow shape, the assignee has, in the past, studied and tested improvements to the cited procedure, such improvements being the subject of Italian patent application No. IT 83358 A/83, which corresponds to U.S. Pat. No. 4,539,802.

Such improvements envisage that such remaining tails of yarn are obtained by firstly making substantially parallel the fibers to be plucked and/or torn and by thereafter performing a substantially axial plucking and/or tearing action on the yarns, by which action the taper of the remaining tails of the yarns reaches the neighborhood of the periphery of the retwisting rings.

The resultant remaining tails are controlled and positioned alongside the yarns before the action to reimpart the required retwisting is begun.

The present assignee has filed also an application Ser. No. 583,397, now U.S. Pat. No. 4,545,191, concerning a mechanical splicer device able to perform the improved procedure described above. This splicer device comprises:

plate means with untwisting-retwisting ring means cooperating at least momentarily with retwisting means, means to couple the yarns together, means to pluck and/or tear excessive tail ends of yarn, means to clamp twists in the segments of yarn which are not to be torn, and inner clamping means which act on the two yarns at least momentarily.

This splicer device includes also:

yarn-coupling means consisting of a pair of means which approach each other at least momentarily, means to balance twists, which act on excessive tail ends of yarn at least momentarily, means to bring remaining small tails of yarn close to the neighboring whole yarns, and plucking and/or tearing means which act directly on the tails of the yarn axially at least momentarily.

The purpose of the above cited means to balance twists is to create a controlled segment of yarn tail, in which segment is accumulated a number of twists substantially equal to and having a sign opposite to the number of twists which are accumulated in the segment of yarn tail contained between the inner clamping means and the outer periphery of the rings.

In this way, when the rings are opened, such opposed twists can be balanced and can cancel each other, as required in the procedure disclosed in U.S. Pat. No. 4,539,802.

Control of the number of twists thus accumulated in the tail ends of the yarns is made possible by conditioning the momentary phase of actuation of such means to balance twists or possibly by conditioning the length of the segment of yarn controlled outside the rings.

The present assignee has disclosed also in their further Italian patent application No. IT 83443 A/83, U.S. application Ser. No. 637,570 filed Aug. 3, 1982, now U.S. Pat. No. 4,590,753, improvements to the procedure described above for the splicing of yarns.

According to these improvements at least part of the untwisting segment of yarn undergoes a drawing action during the untwisting step, at least at about the transient stage of passing from one twist to another (from "Z" to "S" or from "S" to "Z"). This drawing action causes thinner yarns, with reciprocal sliding of the fibers in relation to each other during untwisting and with the formation of points of free fibers.

The results are a thinner splice and better cooperation between the fibers of the two yarns; the consequent splice, moreover, can hardly be distinguished from the rest of the yarn.

A purpose of the present invention is to provide improvements for splicer devices for the mechanical splicing of textile yarns, such improvements being able to obtain not only the procedure described in the cited U.S. Pat. No. 4,539,802 but also, in a variant, the procedure disclosed in the cited patent application Ser. No. 637,570, now U.S. Pat. No. 4,590,753, and also able to provide effects according to various combinations so as to make the result suitable for individual requirements.

This invention also has the object of improving the functional nature of the means to balance twists and of the plucking and/or tearing means, both of such means already present in the devices developed earlier by the present assignee.

According to the improvements of the present invention the adjustment of the means to balance twists can be performed in a very simple manner, for it is sufficient to regulate one single means to balance twists, the other means to balance twists being moved by and being synchronized with the first means through a suitable transmission.

As stated earlier, the improvements of the invention concern also the means to pluck and/or tear excessive tail ends of yarn. The working "pluck and/or tear" means that the operation for removal of such tail ends may include an aspect of plucking or tearing; there will be plucking in the event of short fibers and tearing in the event of longer fibers, and there may be as aspect of plucking in conjunction with tearing in intermediate cases.

According to the present invention the engagement of the yarn by the plucking and/or tearing means takes place in such a way that it does not upset the parallelism or the correct diametral positioning of the yarns. This is accomplished by assuring that the movable parts, or jaws, of such plucking and/or tearing means are able to move in opposite directions and in correspondence with the points of engagement of the yarn which are located at diametrically opposite parts of the plate means.

As compared to earlier embodiments produced by the present assignee, the present invention has the additional purpose of rationalising all the actuation systems so as to provide various advantages such as working economy through a lower motive power requirement, ease of maintenance and technical service, reduction of stocks of spare parts, easy regulation to suit various operating requirements and ease of timing.

According to the invention separate regulation systems are provided for the reciprocal approach and distancing of the plate means, or plates. This allows one to have independent regulation systems for the two steps of rotation and counterrotation respectively.

In a preferred embodiment one of the plates has its forward movement adjustable by means of an appropriate adjustment cam during rotation.

Instead, the other plates has its backward movement adjustable during counterrotation.

The two independent regulation systems which can be thus obtained can be combined so as to accomplish the best splicing results.

In fact, the adjustment of forward movement of one of the plates enables the moment of the start of contact between the plates to be graduated during rotation and therefore enables the untwisting to be regulated as required.

Instead, adjustment of the backward movement of the other plate enables the moment of separation of such plates to be regulated during counterrotation and thus enables retwisting to be regulated as required.

In this way the device can be adapted to every type of yarn by merely regulating the quantity of negative twists imparted and the quantity of positive twists imparted independently of each other so as to obtain the best splicing result.

The improvements of the invention provide also for spacer means able to lessen friction between the opposed surfaces of the plate means in reciprocal movement.

Such spacer means, which in one embodiment consist of facing friction-resistant surfaces sliding against each other, for instance metallic surfaces, keep the minimum distance between the working surfaces of the plate means at a desired value, which may possibly be made adjustable and be such as to make such surfaces act on the yarn located between them without coming into reciprocal sliding contact.

In this way excessive stresses in actuating the device are obviated advantageously, and wear of the working surfaces of the plate means is reduced considerably.

Another advantage following on the presence of such spacer means consists in the fact that such means enable the pressure exerted on the yarn by the working surfaces to be graduated.

It is thus possible to avoid an excessive flattening of the yarn, which would cause a damaging change in the section of the yarn and would lead to an uncontrolled alteration of the natural distribution of the fibers.

A reduction in such pressure on the yarn entails also a better and more regular rolling of the yarn and improves its outward appearance as well.

It lies within the ability and spirit of the invention to embody such spacer means as means to exert a pre-set control of the forward movement of the plates, and such means can form a part of the means which actuate the forward movement of such plates.

In the device of the invention all the steps are set in motion by actuation means, which consist preferably of cams. Such cams act preferably within the arc of one revolution of the shaft from which the device gets its motion.

Moreover, according to the improvements of the invention the actuation of the rotation of the plate means is controlled by two separate cam tracks respectively.

In this way, depending on the conformation and timing applied to such tracks, it is possible to arrange the laws of motion of the two plates as required, independently of each other.

According to the invention such laws of motion can be made the same or different for the two plates, depending on the specific required conformation of the respective control tracks.

In a variant the improvements of the invention arrange for means able to carry out a controlled graduatable drawing of the yarn during the untwisting step according to the procedure disclosed in patent application Ser. No. 637,570, now U.S. Pat. No. 4,590,753.

As has been mentioned supra, such drawing has the purpose of causing a required controlled thinning of the yarns together with a reciprocal sliding of the fibers against each other during untwisting and with the creation of points of free fibers.

Such drawing can be carried out not only on the tail ends to be plucked and/or torn but also on segments of yarn which are not to be plucked and/or torn.

A controlled thinning effect is obtained in this way, particularly in the central zone in relation to the retwisting disk means.

Whenever tensioner means located at a suitable distance from the outer periphery of the rings are employed to tension the tail ends to be plucked and/or torn so as to obtain the required drawing, such tensioner means can also perform the function of means to balance twists.

It is possible according to the invention to arrange for such tensioner means to cooperate with the means to balance twists or to operate also as means to balance twists.

In a further variant a first tensioning can be carried out initially, during at least part of the untwisting, not only on the tail ends of the yarn but also on segments of yarn which are not to be plucked and/or torn, such tensioning accomplishing thereby the required effect of making the yarns thin. The segment of yarn not to be plucked and/or torn can then be released.

Thereafter the tail end of yarn to be plucked and/or torn can be further tensioned, for instance by means of an additional travel of the means which can engage the tail end itself and which form a part of the tensioner means.

Such further travel, which takes place after the rings have been opened, enables the twists built up outside the rings to enter the segment of yarn inside the rings and thus to balance the twists.

This invention is therefore obtained with improvements to splicer devices for the mechanical splicing of textile yarns, by which improvements such splice is made by coupling two single untwisted yarns and by reimparting the twists thereafter and a part of such single yarns is untwisted until twists of an opposite sign to the original twists have been imparted, and by which improvements such yarns can be subjected to a drawing action at least momentarily during untwisting and are then coupled, remaining small tails of the yarns being obtained, and a desired twist is imparted to the coupled segment of yarn by retwisting, such splicer devices comprising:

plate means with untwist-retwist ring means which cooperate at least momentarily with retwist means, such ring means and/or retwist means possibly including operational means, means to couple yarns, means to pluck and/or tear excessive tail ends of yarns, such means acting directly and at least momentarily along the axis of such tail ends and, each of them, comprising a stationary portion and a movable portion to engage the yarn, means to clamp the twists in the segments of yarn which are not to be torn, and means to bring the remaining small tails of yarn close to the adjacent whole yarns, inner clamp means which act at least momentarily on the two yarns and also means to balance twists which act at least momentarily on the excessive tail ends being possibly also comprised, such improvements being characterized by including at least one of the following aspects:

adjustable cam means which condition the mutual approach of such plate means, adjustable cam means which condition the mutual distancing of such plate means, spacer means able to keep at least momentarily the facing working surfaces of disk means and/or ring means at a required distance from each other, movable portions of the plucking and/or tearing means which can move in opposite directions to engage the tails of yarn to be torn, and means to tension the yarns, which means perform a drawing action, the surfaces on which the operational means are positioned being conformed as required.

The invention is embodied also with a splicer device which disassembles and recomposes the yarn mechanically and is characterized by employing improvements as disclosed above.

There is described hereinafter, as a non-restrictive example, a preferred embodiment of the invention with the help of the attached figures, in which:

FIGS. 1, 2 and 3 give outside views of the device;

FIG. 1*a* shows a detail of the system to regulate the means that balance twists, and also shows the lever that releases the grippers;

FIGS. 4 and 5 give views of a partially opened assemblage of the device;

In the figures a splicer device 10 has a carrying frame 11, which in this example is substantially U-shaped and consists of a base 111 and two side plates 211 and 311 in which various components are fitted and positioned.

Figure 1A:
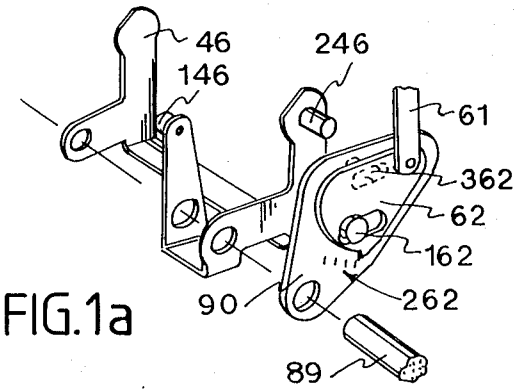
Figure 1:
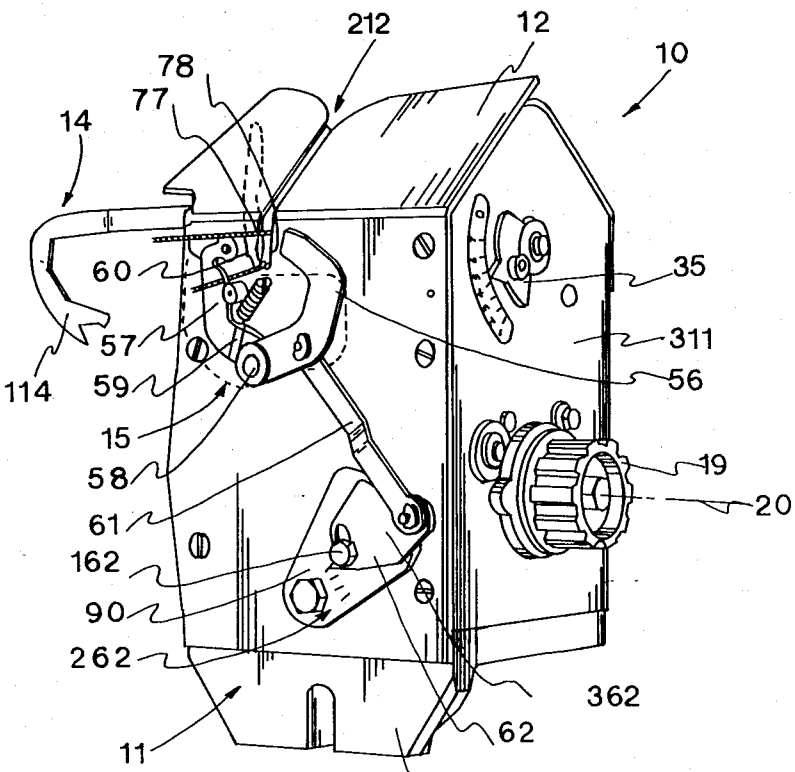
Figure 2:
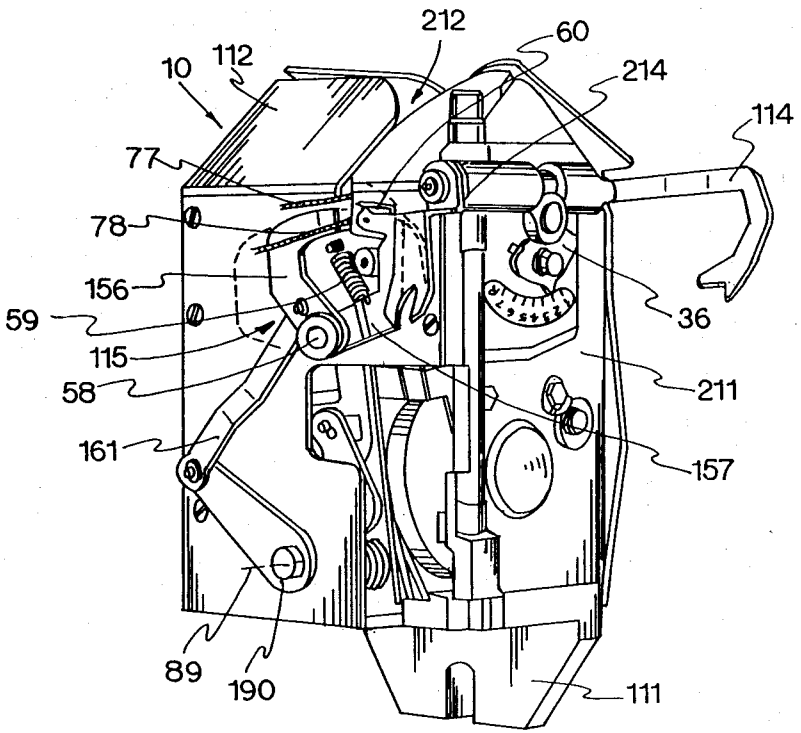

On its front and rear in FIGS. 1 and 2 the device 10 has shields 12 and 112 respectively.

Figure 5:
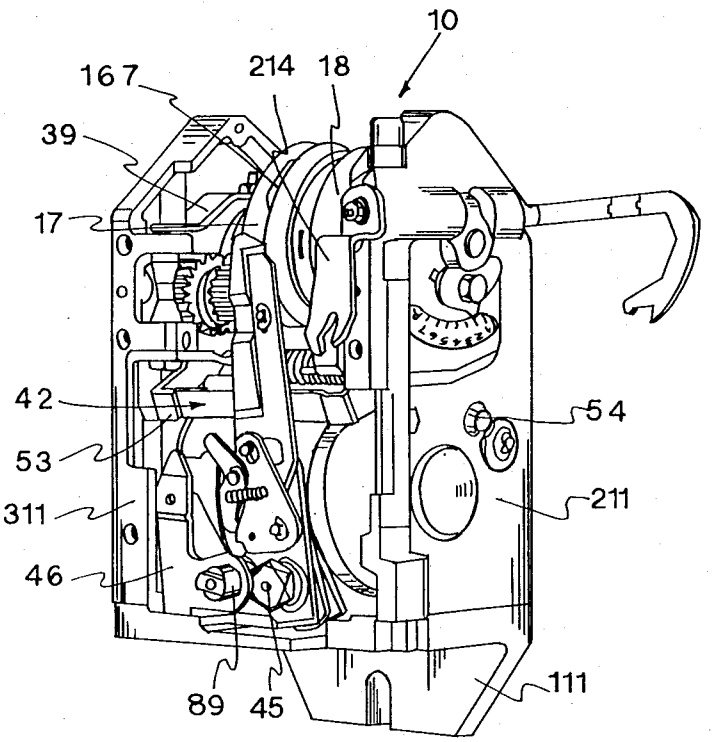
Figure 4:
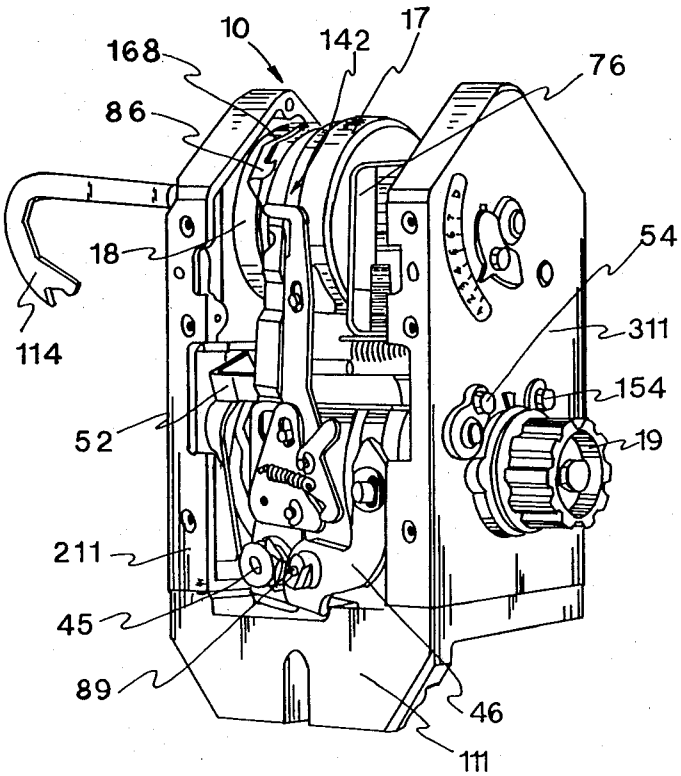

In the examples of FIGS. 4 and 5 the shields 12–112 have been removed so as to allow the inside of the device 10 to be seen partially.

The shields 12–112 include positioner notches 212, which are suitably shaped and serve to enable two yarns which are to be spliced 77–78 to be inserted and positioned in the device 10.

Positioner rods 312 are included in cooperation with the positioner notches 212. In the example shown such rods 312 are solidly fixed to plate means 13 (FIG. 3) marked with lines of dashes in FIGS. 1 and 2 so as to allow means 15–115 which balance twists to be seen.

The device 10 comprises means 14 to discharge yarn, which in this example include two arms, 114 and 214 respectively, with shaped ends; in this case the arms 114–214 can be actuated by a machine (not shown here) to which the device 10 is fitted, but could also be actuated by the device 10 itself.

According to the invention one or both of the arms 114–214 can also perform the function of inserting the yarn, perhaps in cooperation with auxiliary yarn-insertion means located on the machine to which the device 10 is fitted.

In this example such actuation takes place by means of a rod 16 comprising teeth. This rod 16 is actuated at its lower end at 116 (FIG. 3), as said above, by the machine to which the device 10 is fitted, and engages with its upper portion a toothed segment of a shaft 216 which bears the arms 114–214 at its ends.

A torsion spring 316 in this example returns the shaft 216 and therewith the arms 114–214 to the position shown for discharge of the yarn.

The yarns 77–78 are inserted in the device 10 through the positioner notches 212, so that the yarns 77–78 become positioned between plate means 17 and 18, which are opened at the beginning of the splicing procedure.

In the example shown the yarns 77–78 are positioned substantially parallel (see also FIGS. 14 to 19).

The means 15–115 to balance twists are also shown in FIGS. 1 and 2. In this case these means 15–115 comprise a pressure jaw 56–156 and a yielding jaw 57–157, both jaws being pivoted at 58.

The yielding jaw 57–157 is returned by spring means 59 and includes a small block 60 which can rotate through a certain angle on or in its support seating in both directions for an excellent engagement of the yarn, the block 60 being able to adapt itself to the working profile of the pressure jaw 56–156.

The pressure jaw 56–156 is actuated by a connecting rod 61–161, which is connected rotatably to an adjustment plate 62, the position of which can be adjusted in relation to a lever 90 by screw means 162 and can be read by means of nicks 262 or equivalent means (FIGS. 1 and 1*a*).

Such plate 62 is moved, by means of a pin 362, by a lug 246 of a lever 46, which is actuated by a track 27 on a drum 21 (FIG. 6), such track 27 acting on a lug 146. The lever 46 is installed so as to idle on a shaft 89.

Motion is transmitted by the plate 62 to the lever 90, to which the plate 62 is solidly fixed momentarily.

The lever 90 in its turn rotates the shaft 80 and therewith a lever 190 relative to the other means 115 that balances twists. In fact, the levers 90–190 are solidly fixed to the opposite ends of the shaft 89.

In this way one single adjustment plate 62 serves both the means 15–115 that balance twists and thus facilitates the adjustment and timing, which in this way are performed at one single point; thus the actuation, setting, adjustment and timing of the means 15–115 are simplified.

In the following text the lever 46 is also called a "release lever" since it cooperates with projections 149 to release grippers 42–142 (see FIGS. 11–12).

Functioning takes place as follows; the adjustable plate 62 enables the momentary position for action by the twist-balancing means 15–115 to be determined.

The track 27 acts on the lug 146 of the lever 46 and causes rotation of the levers 90–190 and therefore actuation of the jaws 56–156 by means of the arms or connecting rods 61–161.

An excessive tail end of yarn 177–178, which was contained initially between the end of the jaw 56–156 and the small block 60, now becomes gripped between the jaw 56–156 and small block 60.

Next, with an action conditioned by the track 27 the levers 90–190 rotate further and the jaw 56–156 thrusts further the block 60, which retreats together with the movable jaw 57–157 resiliently resisted at 59.

The tail end 177–178 (see FIG. 18) of the engaged yarn 77–78 is now put under tension, such tension being made axial by an abutment formed by the edge of the positioner notch 212, and undergoes also an action which can also be a pre-plucking action and which facilitates the next operation of the plucking and/or tearing means 42–142.

As we said earlier, the tensioning of the tail ends 177–178 by the means 15–115 that balance twists has the purpose of enabling the twists in the zone between untwisting and retwisting rings 63–64 and inner clamp means 73 to be balanced with the twists in the zone located outside the rings 63–64 and stretching up to the point of engagement of the yarn between the jaw 56–156 and the block 60.

The provision of a momentarily determinable action of the twist-balancing means 15–115 has the result that it is possible to determine as required the moment at which, during or at the end of untwisting, a segment of yarn with controlled twists is created in the segment of tail end of yarn outside the rings 63–64.

Such regulation in this embodiment takes place in a very simple manner by means of the adjustment plate 62.

As stated above, it is possible in this way to determine the number of twists accumulated, so that, when the rings 63–64 are opened, the twists in the controlled segment balance the opposite twists in the segment contained between the periphery of the rings 63–64 and the inner clamp means 73, thus leading to excessive tail ends 177–178 which may be substantially devoid of twists before such tail ends 177–178 are plucked and/or torn.

So as to assist such balancing of twists, the actuation of the twist-balancing means 15–115 may provide a slight further travel, which has the function of tensioning the yarn. This facilitates compensation between the opposite twists contained in the segments of yarn in question.

Motion to actuate the device 10 enters in a known manner with the required characteristics by means of a motion-input wheel 19 having an axis of rotation 20.

Figure 12:
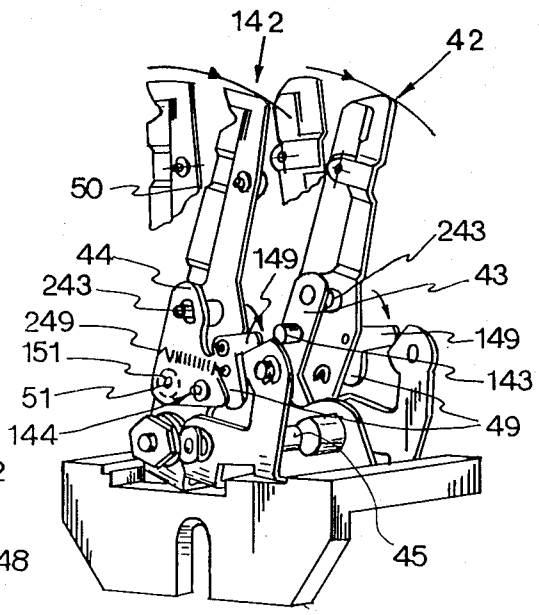
FIGS. 11 and 12 show the plucking and/or tearing means, or grippers.
Figure 13:
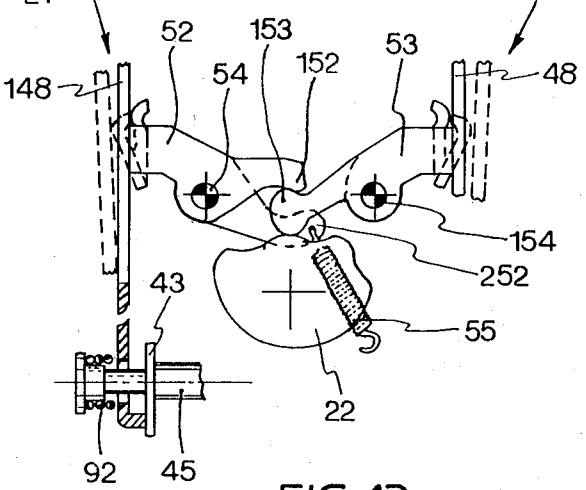
FIG. 13 shows the actuation system for axial movement of the grippers.
Figure 11:
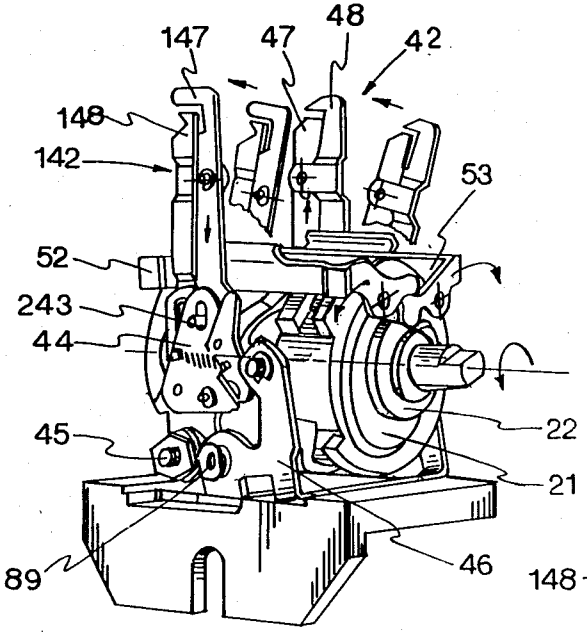

Such motion-input wheel 19 transmits rotation to the drum-type cam or drum 21 and to a cam 22 which actuates fins 52–53, such cam 22 being coaxial with the drum-type cam 21 (see FIGS. 11–13).

Figure 7:
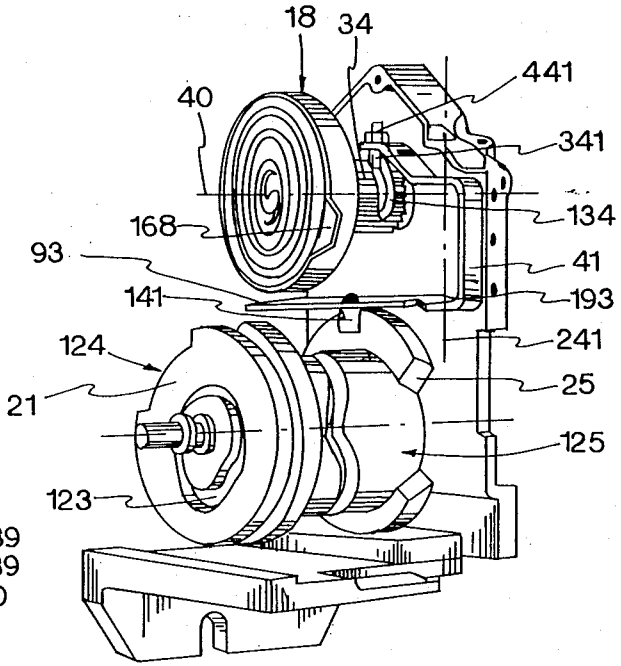
FIGS. 6, 7 and 8 show the actuation systems for the forward movement of the plate means.
Figure 8:
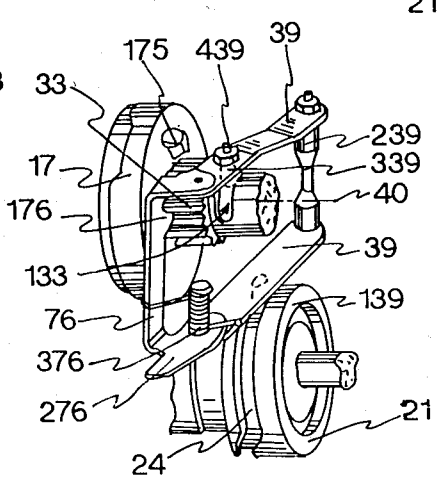
Figure 6:
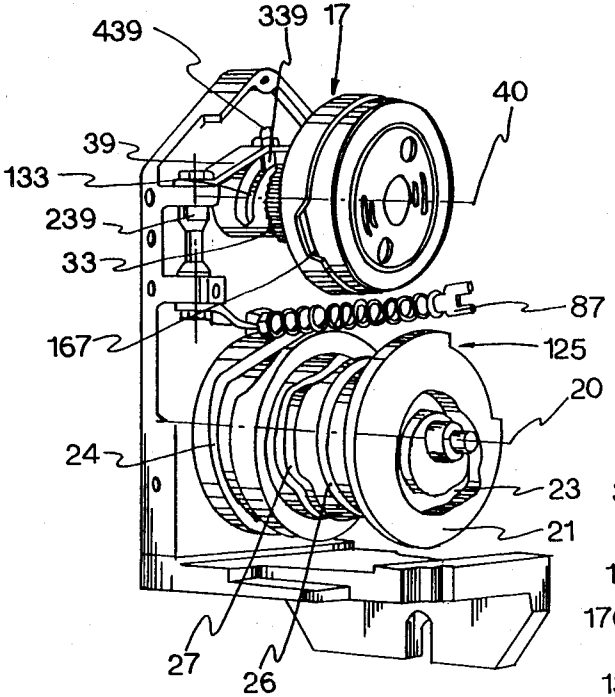

Such drum-type cam 21 comprises in this example six paths or tracks, which can be seen in particular in FIGS. 6 and 7.

A track 23 on the front of the drum 21 controls the rotation of one 18 of the plate means 17–18.

Another track 123, which in this example is identical to the track 23 but which can have another conformation, is machined on the opposite face of the drum 21 (see FIG. 7).

Figure 9:
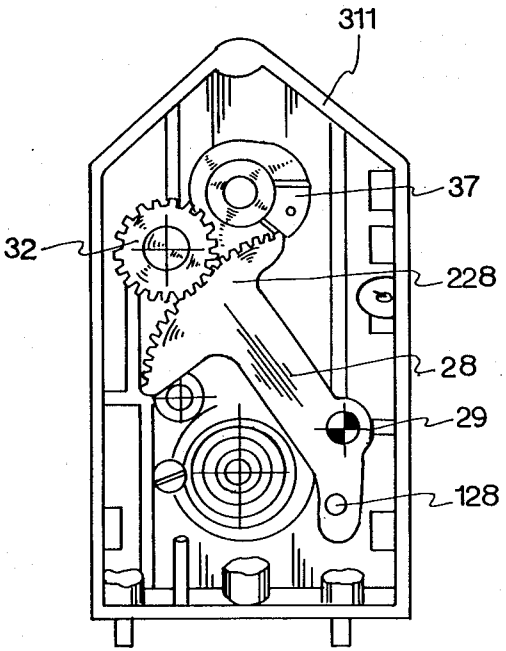

Such track 123 acts on a lug 128 of a lever 28 which rotates the plate means 17–18 and which is oscillated on an axis 29 (FIG. 9).

The lever 28 that rotates the plate means 17 comprises a toothed sector 228 that meshes with a motion-inversion gear wheel 32, which in turn transmits motion to a gear wheel 33 of the plate means 17.

Rotation of the outer plate 18 is obtained by means of an analogous lever 30 (FIG. 10) pivoted at 31.

A lug 130 on such lever 30 is engaged in the track 23 (see FIG. 6). The lever 30 with a toothed sector 230 actuates a gear wheel 34 of the plate 18 directly.

The inclusion of the gear wheel 32 to invert motion for one 17 of the plates 17–18 serves in this instance to impart reciprocally opposed rotations to the plates 17–18, the tracks 23–123 being conformed in an identical manner in the embodiment shown. This result can also be obtained by shaping the tracks 23–123 suitably instead of providing a motion-inversion gear wheel.

A track 24 (see FIGS. 6 and 7) serves to move the plate means 17 forward towards the plate means 18 and, in this example, to govern part of the reciprocal interactions between the plate means 17–18.

Such track 24 contains a cutaway portion 124 in correspondence with which the actuation of the plate 17 is controlled by a separate adjustable cam 37 (see FIG. 9).

Figure 10:
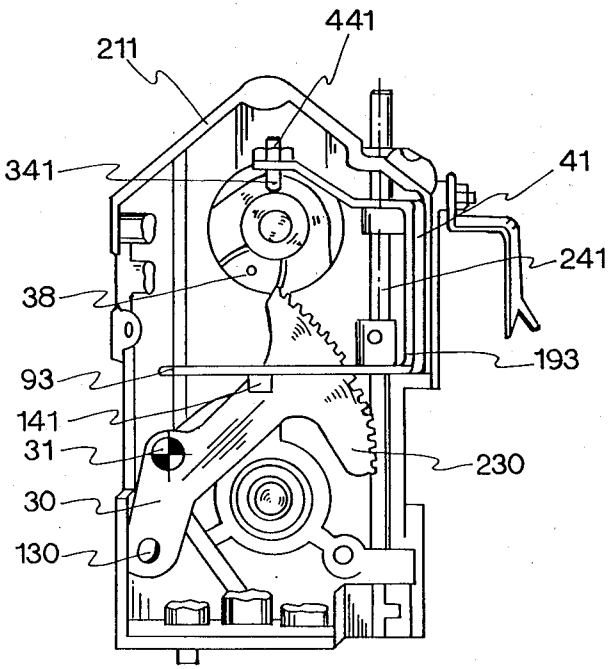
FIGS. 9 and 10 show the actuation systems for rotation of the plate means.

Likewise, a track 25 contains a cutaway portion 125 corresponding to actuation by a separate cam 38 (see FIGS. 7 and 10). Such cam 38 controls the start of the retreat of the plate 18 at the end of retwisting.

By adjusting such cams 37–38 separately it is possible to determine separately the angle of rotation to which the start of untwisting corresponds, and also the angle of counterrotation to which the end of retwisting corresponds, so as to obtain the best splicing results in each individual case.

The track 24 on the cam 21 acts on a lug 139 on a U-shaped lever 39 which can rotate about an axis 239. Such lever 39 acts with its lug 339 on a lug-lodgement recess 133 comprised in cooperation with the gear wheel 33 solidly fixed to the plate means 17.

This enables the plate means 17 to move lengthwise along its axis 40 according to conditionings produced by the track 24.

The lug 339 comprises an eccentric means 439 with a locknut to pre-set the forward movement of the plate 17.

The track 25 acts on a lug 141 of a U-shaped lever 41 having an axis 241 (see FIG. 7).

In its turn the lever 41 governs the forward movement of the plate 18 by means of a lug 341 cooperating with a lug-lodgement recess 134 analogous to the recess 133.

The lug 341 too comprises an adjustment means 441 wholly analogous to the adjustable eccentric 439 of the U-shaped lever 39.

Since in this example the track 25 has only one sliding surface, the lever 41 is kept pressed against the track 25 by a spring means 87 (see FIG. 6) which rests at its opposite ends against the lever 41 and lever 39 respectively.

In correspondence with the cutaway portion 125 the retreat of the plate 18 is governed by the cam 38, by means of which it is possible to regulate the angle at which it is desired that the retwisting should stop.

Figure 3:
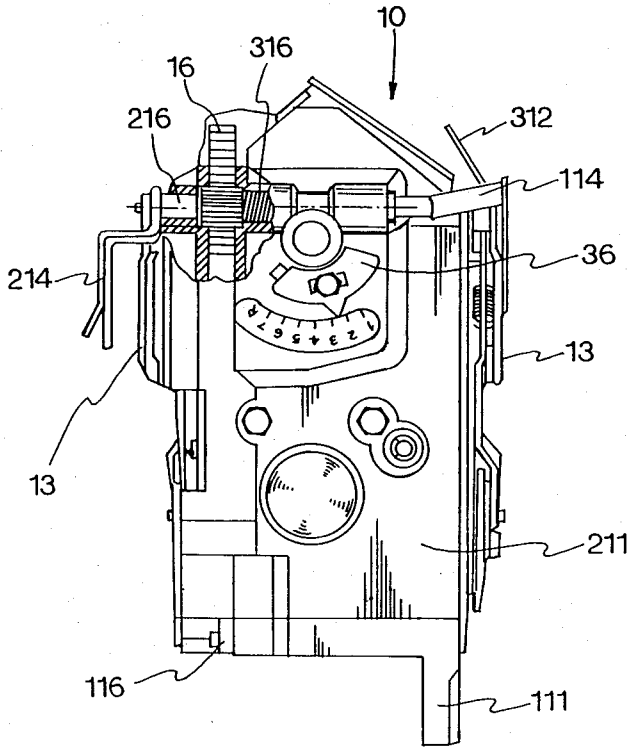

So as to perform such adjustments, the cams 37–38 are solidly fixed to adjustable sectors 35–36 having analogous natures and located on the side plates 311 and 211 respectively and capable of being clamped by screw means at the required angle. Such angle can be read with indicators such as reference notches or the like (FIGS. 1–2–3).

FIGS. 4 and 5 and, in greater detail, FIGS. 11 and 12 show the plucking and/or tearing means 42–142, which will also be called the grippers 42–142 hereinafter for the sake of brevity.

As shown in FIGS. 11 and 12 such grippers 42–142 are actuated by means of a U-shaped lever 43, of which a lug 143 is engaged in a track 26 on the drum 21.

Such U-shaped lever 43 comprises, in correspondence with each gripper 42–142, an actuation pin or projection 243, which engages a lever means 44; the grippers 42–142 are fitted so as to idle on a shaft 45.

The release of the grippers 42–142 is governed by the release lever 46, which actuates in a coordinated manner also the movement of the twist-balancing means 15–115, as described earlier (see FIG. 1*a*).

Such independent actuation of the release, by the release lever 46 in this case, entails the advantage, according to the improvements of the invention, that it is possible to determine the moment of release of the torn tail ends of yarn 177–178 independently of the travel of the grippers 42–142.

This enables the whole travel of such grippers 42–142 to be used for the plucking and/or tearing, the release being actuated in an active and not passive manner.

The employment of the lever 46 that actuates the plate 62 enables the actuation systems to be simplified without any need to arrange a further separate track on the drum 21 for active actuation of release of the grippers 42–142.

The structure of the grippers 42–142 makes it possible to obtain an action of engagement of the yarn 77–78 such that the yarns always remain in a direction along a diameter of the plates 17–18.

This is obtained owing to the fact that movable portions 47–147 of the two grippers 42–142 move in opposite directions, which are therefore such as to displace the two yarns 77–78 in opposite directions while being gripped.

Thus the displacements of the two yarns 77–78 compensate for each other and keep the yarns perfectly parallel and maintain their exact diametral positioning also in this way.

Such action accomplishes also the purpose of a better reciprocal approach of the yarns 77–78 in the zone of the tail ends 177–178 to be torn.

The structure of the grippers 42–142 is shown in particular in FIGS. 11–12. In these figures it is possible to see that the grippers 42–142 have a stationary portion 48–148 and a movable portion 47–147.

Functioning takes place as follows. The gripper 42–142, which is initially in its position of rest, is brought to its position to engage the excessive tail end 177–178 (see FIG. 18) by the action of the actuation pin 243.

The stationary portion 48–148 abuts against an abutment 93–193 comprised on the actuation lever 41 (see FIG. 10), and a further displacement of the pin 243 causes rotation of the lever 44 about its fulcrum 144. The lever 44 is engaged in this way by a hook means 49 with a spring 249.

By such rotation the lever 44 causes the closure of the movable portion 47–147 by means of a pin 51 with a resilient ring 151, which acts on the movable portion 47–147.

The movable portion 47–147 is guided at 50 by a pin/slot coupling.

The resilient yielding of the ring 151 determines the clamping force exerted on the tail end 177–178.

Axial plucking of the tail ends of yarn is actuated by the fin-actuation cam 22, which is coaxial with the drum 21 and acts on a lever 153 of the fin 53 (FIG. 13). Such lever 153 in its turn acts on a lever 152 of the fin 52.

The fins 52–53 are rotatably anchored to the side plates 211–311 respectively at 54–154. In the example shown the fin 52 comprises a projection 252 connected to return spring means 55.

These fins 53–52 act on the stationary portions 48–148 of the grippers 42–142 respectively and cause them to move outwards substantially along the axis of the yarns 77–78 (see the position drawn with lines of dashes in FIG. 13).

Such movement is made possible by the special anchorage of the grippers 42–142 (FIG. 13), which can open outwards, being returned by a spring means 92, which in this example is a compression spring.

The steps in the movement of the grippers 42–142, therefore, include at least:

a movement to engage the yarn, substantially crosswise to the yarns 77–78, a plucking-tearing movement substantially along the axis of the yarns 77–78, with a displacement of the grippers 42–142 towards the outside of the device 10 (see FIG. 13), a travel substantially crosswise to the yarns 77–78 with the purpose of removing the plucked and/or torn tail ends 177–178 and with a final opening of the grippers 42–142 and discharge of the tail ends 177–178 by known means, and a return travel which brings the grippers 42–142 back to their initial position for a new cycle.

As said earlier, the opening of the grippers 42–142 is performed by an active movement of the lever 46 driven by the track 27.

Such movements, together with possible auxiliary movements, can be conditioned and coordinated as required according to the conformation and timing applied to the track 26 and to the fin-actuation cam 22.

FIGS. 14 to 19 show in particular the plate means 17–18, which can be the same as each other or be differently specialised and/or dimensioned.

The dimensions of the plate means 17–18 and their characteristics and special features can also be varied to suit variations in the type of yarn and/or in the average length of the fibers.

However, both of the plate means 17–18 comprise advantageously an untwist-retwist ring means 63 and 64 respectively and a retwist disk means or disk 65 and 66 respectively. In this example the ring 64 is made in cooperation with and is solidly fixed to the disk 66.

The ring means 63–64 and disks 65–66 are provided with means which prevent them from rotating and being unintentionally separated from containment caisings 67–68; the latter means are known and need not be discussed further.

The disk 65, ring 63 and the ring 64/disk 66 assemblage are kept in position by spring means 69, which here are compression springs.

The position of rest of the disks 65–66 and rings 63–64 is determined by the heads of screws 83–84.

Figures 14, 15, 16:
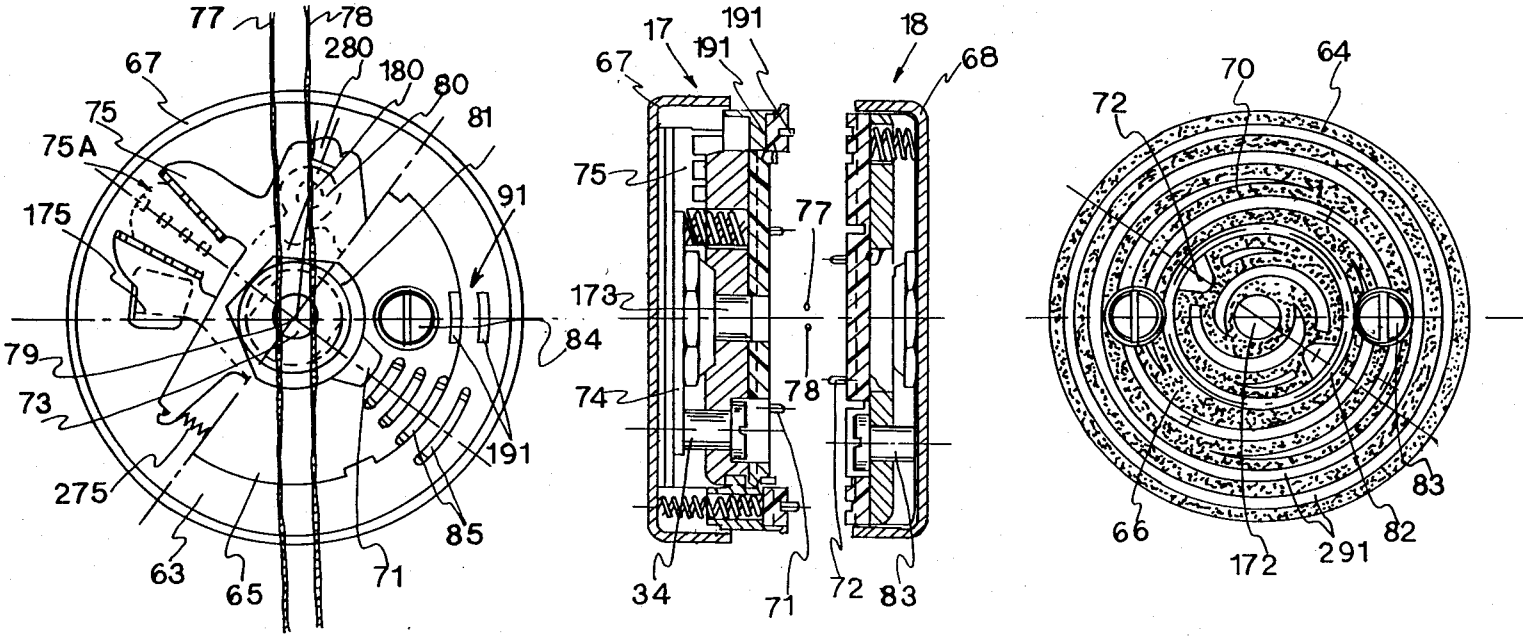
FIGS. 14, 15 and 16 show details of the plate means.

The retwist means or disks 65–66 can be flat, as in FIG. 14, or can be equipped with specialized operational means 70 to suit the specific requirements, as in FIG. 16.

In FIG. 16 the operational means 70 are conformed advantageously in stripes with a development opposite in one half of the retwist means 66 to that of the other half, the stripes being formed in spirals.

Such stripes are advantageously such as to contain spaces between one operational means 70 and its neighbor, so as to provide a lengthwise drawing action on the fibers and hairs on the outside of the yarn.

The operational means 70 can lie substantially on one plane but can lie also on an undulating or curved surface so as to obtain special effects.

The surfaces 70 of one disk and/or ring can be conjugate with the corresponding and/or facing surfaces of the opposite disk and/or ring. In a variant they can also be differentiated.

The retwist means 65 and/or 66 comprise means 71–72 to couple the yarns and also inner means 73 to clamp the yarns 77–78.

The means 71–72 to couple the yarns are provided in a desired position inside the inner periphery of the rings 63–64, such position perhaps being adjustable.

The means 71–72 to couple the yarns consist, in this example, of pairs of pins, and we shall use that name in the following text for the sake of brevity.

The inner clamp means 73 in this case consist of an end surface of a projection 173 (see FIG. 15), and such surface 73 clamps the yarns 77–78 against the retwist means 66 in the central zone of the latter 66.

Such retwist means 66 includes in this instance an insert 172 which coincides with the area where the yarns are clamped, and faces and is opposite to the surface 73.

In any event it is possible to arrange inner clamp means 73 in required radial positions, which possibly may be adjustable. Clamp means 73 can also be provided which can be adjusted separately for each yarn 77–78.

The pins 72 are solidly fixed to the disk 66 and can move with the same in an axial direction as well. The pins 71 likewise are solidly fixed to the disk 65.

In the example shown the pins 71–72 lie on different circumferences but could also lie on the same or neighboring circumferences.

The projection 173 is immovably fixed to a plate 74 solidly secured to the casing 67, and therefore a relative axial displacement takes place between the projection 173 and the disk 65 when the reciprocal axial positions of the casing 67 and disk 65 are varied.

The plate 17 comprises also means 75 to cause approach of small remaining tails of yarn, such means consisting here of combs; such means 75 will be called combs hereinafter.

Such combs 75 are normally closed (position 75A of FIG. 14) at a position below the plane on which the working surfaces lie, and are opened by the action of a prong 176 of a finned lever 76 on a lever 175 that opens the combs 75, before the excessive tail ends of yarn 177–178 are plucked and/or torn.

When the U-shaped lever 39 moves forward, the finned lever 76, which is kept in position by spring means 376, moves forward as well.

When the plate 17 rotates, the prong 176 engages the lever 175 that opens the combs 75, and thus causes the combs 75 to open.

The successive closure of the combs 75 takes place at a moment before the beginning of counterrotation of the plates and after the plucking and/or tearing action carried out by the grippers 42–142.

Such closure is governed by the gripper 142, which in its movement about its axis 45, towards the end of its travel, engages a protrusion 276 of the finned lever 76.

The finned lever 76 is then rotated outwards, overcoming the resistance of spring means 376.

The lever 175 that opens the combs 75 is thus released and causes the closure of the combs 75 by spring means 275 (see FIG. 14).

FIG. 14 shows in particular the combs 75 arranged so as to counterrotate on their axis 79 and normally kept in their closed position 75A by the spring means 275. In FIG. 14 the combs 75 are shown open for greater clarity.

A lever 80 to couple the combs 75 with its pivot at 180 comprises two pins 280 on opposite sides of the pivot 180. Such pins 280 are engaged in corresponding recesses in the combs 75.

In this way, when one comb 75 rotates, an equal and opposite rotation of the other comb 75 rotating on the same axis 79 takes place.

According to the improvements of the invention spacer means 91 are provided which have the purpose of pre-setting a free gap between the opposed surfaces of the plates 17–18, as stated earlier in another part of this description.

In the example shown such means 91 include slide blocks 191 cooperating with the disk 65 and also with the ring means 63.

During the untwisting and retwisting steps such slide blocks 191 slide against slide paths 291 provided on the plate means 18 in coinciding diametral positions.

The height of the slide blocks 191, which can be replaced and/or adjusted, and the depth of the slide paths 291 are chosen so as to leave a pre-set gap between the working surfaces of the disks 65–66 and of the rings 63–64 respectively.

The width of such gap is determined in such a way that the surfaces can press against yarns 77–78 placed between them but never come into contact with each other, thus obviating occurrence of wear and considerable friction and also, as said earlier, avoiding an excessive undesired pressure on the yarn.

The reduction of friction which can be obtained in this way entails also, as stated before, a lower absorption of power by the device and therefore a saving of energy.

The method of working of the device 10 is shown diagrammatically in FIGS. 15, 17, 18 and 19.

Figure 19:
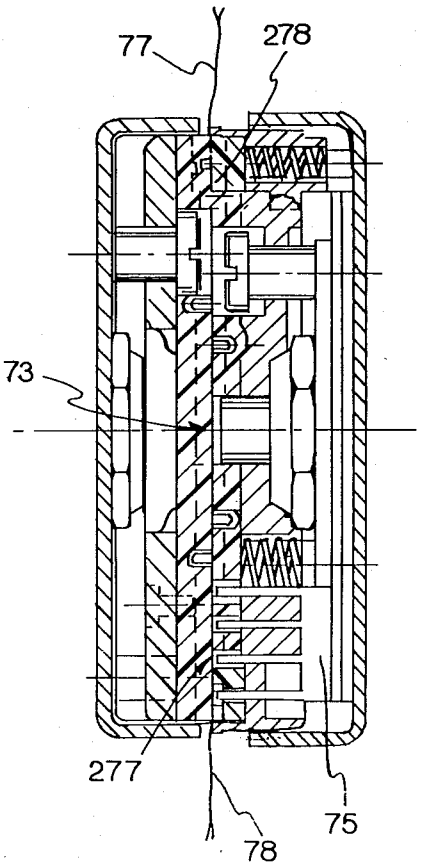
FIGS. 17, 18 and 19 show steps of the working of the plate means.
Figure 18:
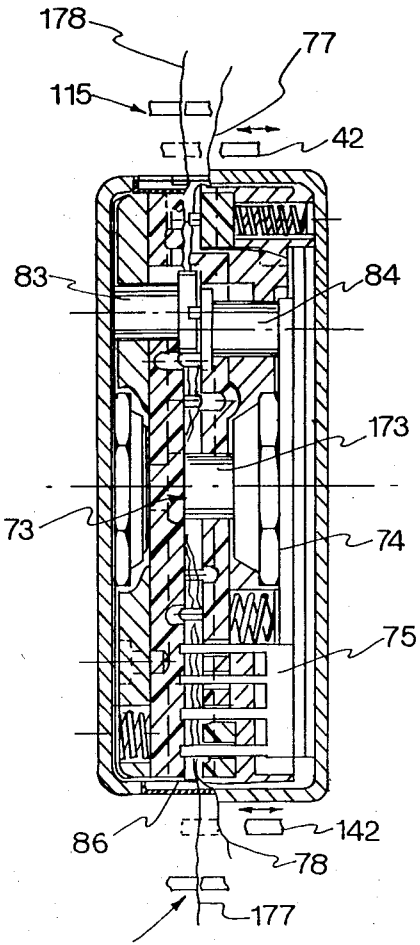
Figure 17:
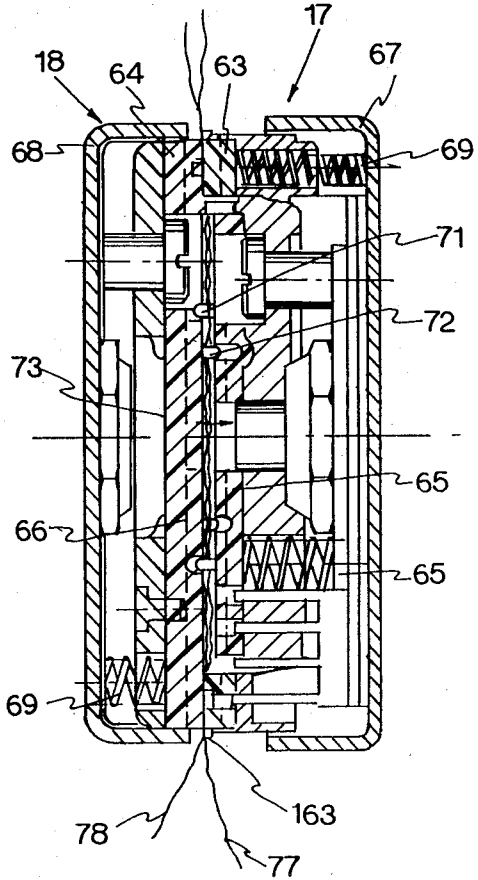

FIG. 15 shows the step of insertion of yarns 77–78; FIG. 17 shows the untwisting action; FIG. 18 shows the action of clamping the yarns 77–78; FIG. 19 shows the start of the retwisting action.

In FIGS. 17, 18 and 19 the plates 17–18 are seen parallel to the extended yarns 77–78 inserted in the device 10. These figures are made along desired sections in this instance so as to give a better view of the various means comprised in the plates 17–18.

With the yarns 77–78 positioned as shown in the figures the rotary motion reaches the motion-input wheel 19. Such motion is advantageously continuous but could also be transmitted in a variable or pulsating manner.

Rotation of the wheel 19 sets in rotation the drum 21, which acts on the various means in relation to the procedure.

In this example substantially the ring means 63–64 alone work during the untwisting step (FIG. 17).

At the end of the untwisting step the pins 71–72 have brought the untwisted yarns 77–78 together in the meantime, thus enabling the central zone of the yarns 77–78, which are substantially parallel and in contact with each other, to be controlled.

In this example the pins 71–72 are lodged in circumferential hollows 82–81 respectively made in the disks 66–65 respectively.

The projection 173, and also an insert 172 in this case, are shaped so as not to interrupt the continuity of such hollows 81–82.

The combs 75, which are already in a circumferential position corresponding to the yarns 77–78 at the end of untwisting, are opened by the action of the finned lever 76 on the lever 175 that opens the combs 75.

Such combs 75, still open, are caused to protrude through circumferential slots 85 in the disk 65 and ring 63 when the plates 17–18 are thrust against each other, as shown in FIG. 18.

The plates 17–18 are then thrust against each other. Owing to this the clamp means 73 thrust the disk 66 and ring 64 and force them to enter the casing 68, whereas the screws 83 prevent the disk 65 from moving forward, and therefore the ring 63 too cannot move forward as it is held by an edge 163 against the casing 68.

The yarns 77–78 are clamped in this way between the surfaces 73–172 in their central segment coinciding with the clamp means 73 but are not constrained by the surfaces of the disks 65–66 or rings 63–64.

The twist-balancing means 15–115 in the meanwhile have engaged the excessive tail ends 177–178, as shown diagrammatically in FIG. 18.

Such means 15–115 carry out tensioning of the yarns 77–78 to the required degree, enabling the twists to be cancelled in the segments of yarn involved, as mentioned earlier.

The gripper means 42–142 engage the yarns 77–78. During the step of plucking and/or tearing the excessive tail ends 177–178 the casings 67–68 are in circumferential contact with each other, but the cutaway portions 167–168 respectively (see FIGS. 6–7) permit the tail ends 177–178 to be plucked and/or torn and leave a passage free for such tail ends.

Instead, means 86 that clamp twists (see FIG. 4) constrain the portions of the yarns 77–78 which are not to be torn, against the outer edge of the ring 63 (FIG. 18) and prevent the negative twists comprised in the segment of the yarns 77–78 contained between the outer periphery of the ring means 63–64 and the inner clamp means 73 from becoming lost by spreading along the yarns 77–78 through the cutaway portions 167–168 and outwards beyond the ring means 63–64, and from being cancelled owing to the presence of the positive twists existing outside the rings 63–64.

The clamping produced by the inner clamp means 73 has the effect that the small remaining tails 277–278 of yarn are tapered from a position of greatest thickness in the neigborhood of the clamp means 73 to an end position of smallest thickness in the neighbourhood of the outer periphery of the rings 63–64.

The grippers 42–142 perform the plucking and/or tearing action with a combination of movements conditioned by the track 26 and cam 22 after the twist-balancing means 15–115 have been opened.

Near the end of its travel the gripper 142 presses against the protrusion 276 of the finned lever 76 and thus causes release of the lever 175 by the finned lever 76 itself, with a resultant closure of the combs 75.

The combs 75 then bring the remaining small tails 277–278 near the yarns 78–77 respectively.

The grippers 42–142 are opened by the action of the release lever 46 on the projections 149.

The plucked tail ends 177–178 are discharged by known means when the grippers 42–142 are opened.

The casings 67–68 are now slightly separated (FIG. 19) and the inner clamp surface 73, which is solidly fixed to the casing 67, no longer presses against the disk 66; moreover, the disks 65–66 begin to press against the yarns 77–78 and so also do the rings 63–64 through the action of the spring means 69.

The free gaps between such disks 65–66 and such rings 63–64 respectively are pre-set by the spacer means 91.

The combs 75 move backwards with the retreat of the casing 67, to which they are solidly fixed axially, below the surface of the disk 65, thus freeing the remaining tails 277–278 and yarns 78–77, which have now been positioned adjacent to each other.

The yarns 77–78 are therefore now controlled along the whole extent of the disks 65–66 and rings 63–64.

FIG. 19 shows the start of the retwisting step, with the means 73 no longer clamping the yarns 77–78 and with the disks 65–66 and rings 63–64 pressing against the yarns 77–78.

During the retwisting step, which, as is known, is performed with a rotation opposite to that of the untwisting step, both the ring means 63–64 and the respective retwist disk means 65–66 cooperate in obtaining the required degree of retwisting.

During retwisting, the pins 71–72 move away from each other, running within their respective hollows 82–81 and ensuring lack of contact with the coupled yarns.

At the end of the retwisting, the plates 17–18 move apart from each other, such movement being conditioned by the adjustable cam 38, which acts on the plate 18.

The means 14 which discharge yarn expel the spliced yarn from the device 10.

Figure 21:
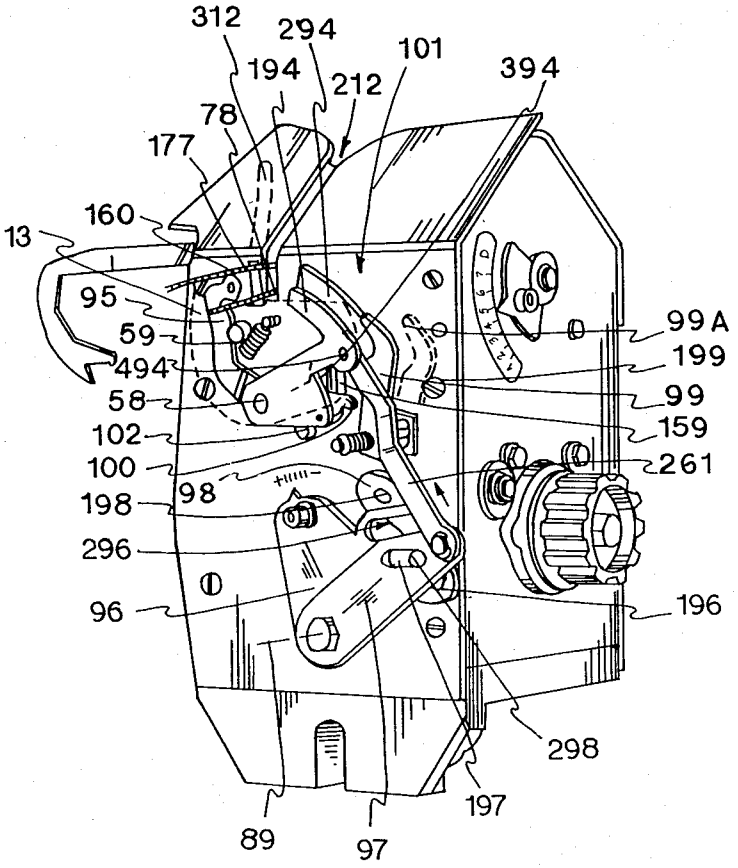
FIGS. 20 and 21 show means to tension the yarn.
Figure 20:
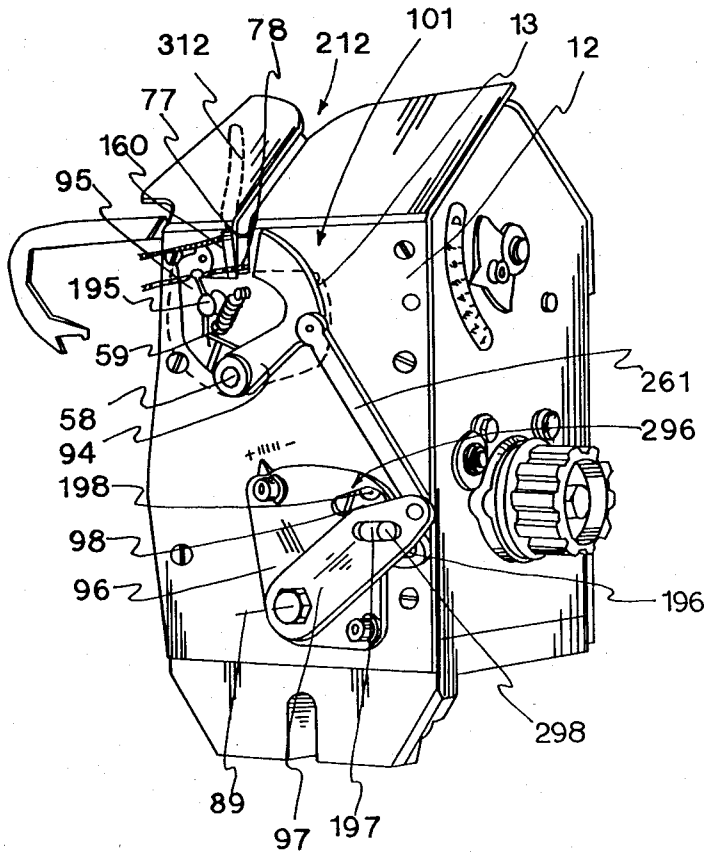

FIGS. 20 and 21 show a possible embodiment of means 101 to tension yarns.

A rocker arm 98 is drawn by the lug 246 of the lever 46 by means of a movable pin or pivot 198 (see FIG. 1*a*).

This arm 98, which can rotate about such pivot 198, actuates a crank 97 by means of an actuation lug 298. An inclined slot 197 in the crank 97 cooperates with the lug 298.

An adjustable cam 96 conditions the radial position of the lug 298 in relation to an axis 89 of rotation.

When the lug 298 is located within a circumferential track 196 its radial position stays unchanged.

When such lug 298 engages an inclined track 296, its radial position varies, the distance between the lug 298 and the axis 89 being reduced in this example.

Thus the angle by which the crank 97 rotates is reduced progressively in relation to the angle by which the pivot 198 moves in relation to the axis 89. This starts from the moment when the lug 298 engages which inclined track 296.

Such variation of angular course takes place owing to the fact that the slot 197 is inclined in relation to the radial direction of the crank 97.

If the overall travel of the pivot 198 remains unchanged, the adjustment of the cam 96 enables the value of the travel of the crank 97 to to be determined.

The travel of a movable pressure jaw 94, which is actuated by the crank 97 through a connecting rod 261, is thus also adjusted.

Such travel determines the value of the traction which the yarns 77–78 undergo after being engaged between the jaw 94 and a block 160 on a yielding jaw 95. An abutment 195 establishes the initial position of such jaw 95.

FIG. 20 shows how the end of the movable yielding jaw 95 and the block 160 have a width such as to enble both the yarns 77–78, which are positioned by means of the positioner notch 212 and positioner rod 312, to be engaged.

FIG. 21 shows a variant suitable for performing tensioning of the tail ends to be plucked and/or torn in two stages, whereas the segments of yarn to be left integral are tensioned once only.

According to such variant two movable jaws, one to "tension yarn" 194 and one to "tension a tail end" 294, are provided. Both these jaws 194–294 are pivoted at 58.

The method of working is as follows. The crank 97 initially actuates the jaw 194 by means of the connecting rod 261. The jaw 194 pulls the jaw 294 by means of an entraining pin 494.

During this travel a hook 99, initially located at 99A and halted by an abutment 199, is tripped. The position 99A is maintained initially by the back of the jaw 294.

The overall travel of the jaws 194–294 is determined by the adjustment imparted to the cam 96, such adjustment taking place in the same way as in FIG. 20.

The jaws 194–294 engage the tail end 177 and the yarn 78 against the block 160.

The further travel of the jaws 194–294, together with the retreat of the block 160, provides the required tensioning of the yarn 78 and of the tail end 177 with a resultant desired drawing effect.

The track 27 on the drum 21, being suitably conformed for this specific case, causes the return of the crank 97 and thus of the jaw 194.

The jaw 294 remains in its closure position with the tail end 177 engaged against the block 160, this jaw 294 being held by the hook 99.

During the return travel of the jaw 194 a hook 100 pivoted on the jaw 194 can be tripped since it is not held by the back of the jaw 294 beyond a certain point in such travel.

This hook 100 can then engage the jaw 294 in correspondence with a recess 394.

The successive forward movement (according to the arrow) of the crank 97, with its movement conditioned by the track 27 on the drum 21, brings the jaw 194 forward once again. The jaw 194 in its turn thrusts the jaw 294 further forward by means of the hook 100.

The staggered positions of the two jaws 194–294 are maintained in this way during this second forward movement.

Of these jaws 194–294, only the jaw 294 can take the tail end 177 for further tensioning, whereas the jaw 194, being further to the rear, can no longer engage the yarn 78 that is to be left integral.

This second forward travel takes place after the opening of the rings 63–64 and disks 65–66, with the yarns 77–78 clamped by the inner clamp means 73.

There follows the entry of the twists accumulated outside the rings 63–64 in the segment of yarn contained between the outer periphery of the rings 63–64 and the tensioner means 101, such twists entering into the segment of tail end 177–178 contained between the periphery of the rings 63–64 and the inner clamp means 73, the method of functioning being analogous to that of the twist-balancing means 15–115.

The successive return of the crank 97 causes the retreat of the jaw 194. Such jaw 194 meets the hook 99 and rotates it clockwise, thus freeing the jaw 294, which retreats owing to the action of a spring 159.

During the further backward movement of the jaw 194 the hook 100 meets an abutment 102 and releases the jaw 294.

The jaw 294 and hook 100 are now re-positioned reciprocally and take up their reciprocal positions of FIG. 21.

Both the jaws 194–294 take up once more their initial positions owing to the action of the crank 97 and connecting rod 261.

The variant of FIG. 21 enables the device to be used also with a method of working analogous to that of the variant of FIG. 20. For this purpose it is enough to clamp the hook 99 in its initial position 99A with known means.

In this way the jaws 194–294 always move firmly fixed together.

The hook 100 cannot trip since the jaws 194–294 do not take up the staggered positions caused by the clamping of the jaw 294 by the hook 99.

Thus the jaws 194–294 act in a manner wholly analogous to the jaw 94 of FIG. 20.

We claim:

1. An improved splicer device for the mechanical splicing of textile yarns wherein splicing is accomplished by coupling two single untwisted yarns, said splicer device comprising:

plate means comprising two opposed plate members movable toward and away from each other, having untwist-retwist ring means that cooperate at least momentarily with retwist means, said ring means and said retwist means having facing working surfaces;

yarn coupling means;

means to balance twists in excessive tail ends;

means to pluck and/or tear excessive tail ends of yarn and thereby leave a small tail, said means acting directly along the axis of said tail ends, said means comprising a stationary portion and a movable portion for engaging the yarn;

means for clamping the twists in the segments of yarn that are not to be torn;

means for bringing the small tails of yarn in the vicinity of adjacent whole yarns;

inner clamp means to act on the two yarns;

first adjustable cam means to control the movement of said plate members toward each other; and second adjustable cam means to control the movement of said plate members away from each other.

2. An improved splicer device for the mechanical splicing of textile yarns wherein splicing is accomplished by coupling two single untwisted yarns, said splicer device comprising:

plate means comprising two opposed plate members movable toward and away from each other, having untwist-retwist ring means that cooperate at least momentarily with retwist means, said ring means and said retwist means having facing working surfaces;

yarn coupling means;

means to balance twists in excessive tail ends;

means to pluck and/or tear excessive tail ends of yarn and thereby leave a small tail, said means acting directly along the axis of said tail ends, said means comprising a stationary portion and a movable portion for engaging the yarn;

means for clamping the twists in the segments of yarn that are not to be torn;

means for bringing the small tails of yarn in the vicinity of adjacent whole yarns;

inner clamp means to act on the two yarns; and spacer means that at least momentarily keep the facing working surfaces of said retwist means and/or said ring means at a required distance from each other.

3. An improved splicer device for the mechanical splicing of textile yarns wherein splicing is accomplished by coupling two single untwisted yarns, said splicer device comprising:

plate means comprising two opposed plate members movable toward and away from each other, having untwist-retwist ring means that cooperate at least momentarily with retwist means, said ring means and said retwist means having facing working surfaces;

yarn coupling means;

means to balance twists in excessive tail ends;

means to pluck and/or tear excessive tail ends or yarn and thereby leave a small tail, said means acting directly along the axis of said tail ends, said means comprising a stationary portion and a movable portion for engaging the yarn;

means for clamping the twists in the segments of yarn that are not to be torn;

means for bringing the small tails of yarn in the vicinity of adjacent whole yarns;

inner clamp means to act on the two yarns; and movable portions on said plucking and/or tearing means that can move in opposite directions to engage the tails of the yarn to be torn.

4. An improved splicer device for the mechanical splicing of textile yarns wherein splicing is accomplished by coupling two single untwisted yarns, said splicer device comprising:

plate means comprising two opposed plate members movable toward and away from each other, having untwist-retwist ring means that cooperate at least momentarily with retwist means, said ring means and said retwist means having facing working surfaces;

yarn coupling means;

means to balance twists in excessive tail ends;

means to pluck and/or tear excessive tail ends of yarn and thereby leave a small tail, said means acting directly along the axis of said tail ends, said means comprising a stationary portion and a movable portion for engaging the yarn;

means for clamping the twists in the segments of yarn that are not to be torn;

means for bringing the small tails of yarn in the vicinity of adjacent whole yarns;

inner clamp means to act on the two yarns; and means for tensioning the yarns, said means for tensioning performing a drawing action.

5. The splicer device of claim 1, further comprising spacer means that at least momentarily keep the facing working surfaces of said retwist means and/or said ring means at a required distance from each other.

6. The splicer device of claim 1, further comprising movable portions on said plucking and/or tearing means that can move in opposite directions to engage the tails of the yarn to be torn.

7. The splicer device of claim 1, further comprising means for tensioning the yarns, said means for tensioning performing a drawing action.

8. The splicer device of claim 1 wherein said first adjustable cam means controls the forward movement of one plate member toward the other plate member during rotation of said plate means and said second adjustable cam means controls the backward movement of one plate member away from the other plate member during counter rotation.

9. The splicer device of claim 8, further comprising lever means for moving one plate member toward the other, said first adjustable cam means momentarily cooperating with said lever means.

10. The splicer device of claim 1, further comprising lever means for moving one plate member toward the other, said first adjustable cam means momentarily cooperating with said lever means.

11. The splicer device of claim 1, further comprising outer adjustment means for controlling the amount of untwisting or retwisting, at least one adjustable cam means cooperating with said outer adjustment means.

12. The splicer device of claim 2 wherein said spacer means comprise opposed cooperating surfaces contained in said plate means.

13. The splicer device of claim 2 wherein said spacer means comprise at least slide block means cooperating with (a) one plate member and (b) corresponding circumferential surfaces on the other plate member, said slide block means and said corresponding circumferential surfaces being at least momentarily in contact with each other.

14. The splicer device of claim 13 wherein said slide block means are in cooperation with said retwist means.

15. The splicer device of claim 14 wherein said slide block means are replaceable.

16. The splicer device of claim 14 wherein said slide block means are adjustable.

17. The splicer device of claim 13 wherein said slide block means are in cooperation with said ring means.

18. The splicer device of claim 17 wherein said slide block means are replaceable.

19. The splicer device of claim 17 wherein said slide block means are adjustable.

20. The splicer device of claim 13 wherein said slide block means are replaceable.

21. The splicer device of claim 13 wherein said slide block means are adjustable.

22. The splicer device of claim 1 further comprising release lever means for actively actuating the release of said plucking and/or tearing means.

23. The splicer device of claim 22 wherein said release lever means actuate at least said means to balance twists.

24. The splicer device of claim 22 wherein said release lever means actuate at least said means for tensioning the yarns.

25. The splicer device of claim 1, further comprising a transmission, wherein one means to balance twists is directly actuated and another means to balance twists is linked to said one means to balance twists by said transmission.

26. The splicer device of claim 25 wherein the directly actuated means to balance twists comprises means to regulate travel and thereby control said another means to balance twists.

27. The splicer device of claim 4 wherein said means for tensioning the yarns act on at least the tail ends of yarn to be plucked and/or torn.

28. The splicer device of claim 27 wherein said means for tensioning the yarns act simultaneously on the tail ends of yarn to be plucked and/or torn and on the segments of yarn to be left integral.

29. The splicer device of claim 28 wherein said means for tensioning the yarns act at least momentarily in cooperation with said means to balance twists.

30. The splicer device of claim 29 wherein said means for tensioning the yarns comprise:

resiliently opposed yielding jaw means and pressure jaw means, said pressure jaw means engaging the yarns against said yielding jaw means.

31. The splicer device of claim 29 wherein said means for tensioning the yarns comprise:

resiliently opposed yielding jaw means;

first pressure jaw means for engaging a tail end of yarn;

second pressure jaw means for engaging a yarn that is to be left integral;

hook means for positioning said first pressure jaw means to engage a tail end of yarn; and hook means for staggering said first pressure jaw means and said second pressure jaw means, said first pressure jaw means being at least momentarily displaced by said second pressure jaw means.

32. The splicer device of claim 28 wherein said means for tensioning the yarns act at least momentarily as means to balance twists.

33. The splicer device of claim 32 wherein said means for tensioning the yarns comprise: p1 resiliently opposed yielding jaw means and pressure jaw means, said pressure jaw means engaging the yarns against said yielding jaw means.

34. The splicer device of claim 32 wherein said means for tensioning the yarns comprise:

resiliently opposed yielding jaw means;

first pressure jaw means for engaging a tail end of yarn;

second pressure jaw means for engaging a yarn that is to be left integral;

hook means for positioning said first pressure jaw means to engage a tail end of yarn; and hook means for staggering said first pressure jaw means and said second pressure jaw means, said first pressure jaw means being at least momentarily displaced by said second pressure jaw means.

35. The splicer device of claim 28 wherein said means for tensioning the yarns comprise:

resiliently opposed yielding jaw means and pressure jaw means, said pressure jaw means engaging the yarns against said yielding jaw means.

36. The splicer device of claim 28 wherein said means for tensioning the yarns comprise:

resiliently opposed yielding jaw means;

first pressure jaw means for engaging a tail end of yarn;

second pressure jaw means for engaging a yarn that is to be left integral;

hook means for positioning said first pressure jaw means to engage a tail end of yarn; and hook means for staggering said first pressure jaw means and said second pressure jaw means, said first pressure jaw means being at least momentarily displaced by said second pressure jaw means.

37. The splicer device of claim 27 wherein said means for tensioning the yarns act separately at least momentarily on the tail ends of the yarn to be plucked and/or torn and on the segments of yarn to be left integral.

38. The splicer device of claim 37 wherein said means for tensioning the yarns act at least momentarily in cooperation with said means to balance twists.

39. The splicer device of claim 38 wherein said means for tensioning the yarns comprise:

resiliently opposed yielding jaw means and pressure jaw means, said pressure jaw means engaging the yarns against said yielding jaw means.

40. The splicer device of claim 38 wherein said means for tensioning the yarns comprise:

resiliently opposed yielding jaw means;

first pressure jaw means for engaging a tail end of yarn;

second pressure jaw means for engaging a yarn that is to be left integral;

hook means for positioning said first pressure jaw means to engage a tail end of yarn; and hook means for staggering said first pressure jaw means and said second pressure jaw means, said first pressure jaw means being at least momentarily displaced by said second pressure jaw means.

41. The splicer device of claim 37 wherein said means for tensioning the yarns act at least momentarily as means to balance twists.

42. The splicer device of claim 41 wherein said means for tensioning the yarns comprise:

resiliently opposed yielding jaw means and pressure jaw means, said pressure jaw means engaging the yarns against said yielding jaw means.

43. The splicer device of claim 41 wherein said means for tensioning the yarns comprise:

resiliently opposed yielding jaw means;

first pressure jaw means for engaging a tail end of yarn;

second pressure jaw means for engaging a yarn that is to be left integral;

hook means for positioning said first pressure jaw means to engage a tail end of yarn; and hook means for staggering said first pressure jaw means and said second pressure jaw means, said first pressure jaw means being at least momentarily displaced by said second pressure jaw means.

44. The splicer device of claim 37 wherein said means for tensioning the yarns comprise:

resiliently opposed yielding jaw means and pressure jaw means, said pressure jaw means engaging the yarns against said yielding jaw means.

45. The splicer device of claim 37 wherein said means for tensioning the yarns comprise:

resiliently opposed yielding jaw means;

first pressure jaw means for engaging a tail end of yarn;

second pressure jaw means for engaging a yarn that is to be left integral;

hook means for positioning said first pressure jaw means to engage a tail end of yarn; and hook means for staggering said first pressure jaw means and said second pressure jaw means, said first pressure jaw means being at least momentarily displaced by said second pressure jaw means.

46. The splicer device of claim 27 wherein said means for tensioning the yarns act at least momentarily in cooperation with said means to balance twists.

47. The splicer device of claim 46 wherein said means for tensioning the yarns comprise:

resiliently opposed yielding jaw means and pressure jaw means, said pressure jaw means engaging the yarns against said yielding jaw means.

48. The splicer device of claim 46 wherein said means for tensioning the yarns comprise:

resiliently opposed yielding jaw means;

first pressure jaw means for engaging a tail end of yarn;

second pressure jaw means for engaging a yarn that is to be left integral;

hook means for positioning said first pressure jaw means to engage a tail end of yarn; and hook means for staggering said first pressure jaw means and said second pressure jaw means, said first pressure jaw means being at least momentarily displaced by said second pressure jaw means.

49. The splicer device of claim 27 wherein said means for tensioning the yarns act at least momentarily as means to balance twists.

50. The splicer device of claim 49 wherein said means for tensioning the yarns comprise:

resiliently opposed yielding jaw means and pressure jaw means, said pressure jaw means engaging the yarns against said yielding jaw means.

51. The splicer device of claim 49 wherein said means for tensioning the yarns comprise:

resiliently opposed yielding jaw means;

first pressure jaw means for engaging a tail end of yarn;

second pressure jaw means for engaging a yarn that is to be left integral;

hook means for positioning said first pressure jaw means to engage a tail end of yarn; and hook means for staggering said first pressure jaw means and said second pressure jaw means, said first pressure jaw means being at least momentarily displaced by said second pressure jaw means.

52. The splicer device of claim 27 wherein said means for tensioning the yarns comprise:

resiliently opposed yielding jaw means and pressure jaw means, said pressure jaw means engaging the yarns against said yielding jaw means.

53. The splicer device of claim 52 wherein said means for tensioning the yarns further comprise a rocker arm means, a pivot means and a crank means with an oblique slot means, said rocker arm means actuating said crank means by said pivot means cooperating with said oblique slot means, and adjustable cam means that control the position of said pivot means.

54. The splicer device of claim 53 wherein said rocker arm means are actuated by a release lever means.

55. The splicer device of claim 27 wherein said means for tensioning the yarns comprise:

resiliently opposed yielding jaw means;

first pressure jaw means for engaging a tail end of yarn;

second pressure jaw means for engaging a yarn that is to be left integral;

hook means for positioning said first pressure jaw means to engage a tail end of yarn; and hook means for staggering said first pressure jaw means and said second pressure jaw means, said first pressure jaw means being at least momentarily displaced by said second pressure jaw means.

56. The splicer device of claim 55 wherein said means for tensioning the yarns further comprise a rocker arm means, a pivot means and a crank means with an oblique slot means, said rocker arm means actuating said crank means by said pivot means cooperating with said oblique slot means, and adjustable cam means that control the position of said pivot means.

57. The splicer device of claim 56 wherein said rocker arm means are actuated by a release lever means.

58. The splicer device of claim 4, further comprising a transmission, wherein a first means for tensioning the yarns is actuated directly and a second means for tensioning the yarn is actuated by said first means through said transmission.

59. The splicer device of claim 1 wherein the facing working surfaces of said ring means and/or said retwist means are flat.

60. The splicer device of claim 59 wherein said retwist means and/or said ring means have complementary opposed surface conformations.

61. The splicer device of claim 59 wherein said retwist means and/or said ring means have different opposed surface conformations.

62. The splicer device of claim 1 wherein the facing working surfaces of said ring means and/or said retwist means are configured to aid in grasping yarns.

63. The splicer device of claim 62 wherein said retwist means and/or said ring means have complementary surface conformations.

64. The splicer device of claim 62 wherein said retwist means and/or said ring means have different opposed surface conformations.

65. The splicer device of claim 1 wherein said inner clamp means are located substantially at the center of said retwist means.

66. The splicer device of claim 1 wherein said inner clamp means are located radially relative to said retwist means.

67. The splicer device of claim 1 wherein said inner clamp means are adjustable.

68. The splicer device of claim 1 wherein said plate means comprise separate systems for activation of rotation.

69. The splicer device of claim 68 wherein rotations of the plate means are actuated by separate tracks on cam means, said tracks providing a required cam formation and timing.

70. The splicer device of claim 1 further comprising means positioned on the surfaces of said ring means and said retwist means to provide a lengthwise drawing action on the fibers on the outside of the yarn.

* * * * *